US006283397B1

(12) United States Patent
Chen

(10) Patent No.: US 6,283,397 B1
(45) Date of Patent: Sep. 4, 2001

(54) VARIABLE AND STEADY YARN FEEDING APPARATUS

(76) Inventor: Jen Hui Chen, No. 775 Chung Cheng Rd., Su-Lin City, Taipei County (TW)

( * ) Notice: Subject to any disclaimer, the term of this patent is extended or adjusted under 35 U.S.C. 154(b) by 0 days.

(21) Appl. No.: 09/315,814

(22) Filed: May 21, 1999

(30) Foreign Application Priority Data

Feb. 22, 1999 (TW) ..... 88201359

(51) Int. Cl.[7] ..... B65H 51/02
(52) U.S. Cl. ..... 242/366; 24/364.5; 66/132 R
(58) Field of Search ..... 242/364.5, 365.9, 242/366, 366.1, 365.6; 66/132 T, 132 R

(56) References Cited

U.S. PATENT DOCUMENTS

| | | | | |
|---|---|---|---|---|
| 3,606,975 | | 9/1971 | Rosen . | |
| 3,908,921 | * | 9/1975 | Jacobsson | 242/364.5 |
| 4,106,713 | * | 8/1978 | Jacobsson | 242/364.5 |
| 4,271,687 | * | 6/1981 | Memminger et al. | 242/364.5 |
| 4,890,464 | | 1/1990 | Tsuchiya et al. | 66/132 T |
| 5,388,747 | * | 2/1995 | Chen | 66/132 R |
| 5,669,245 | * | 9/1997 | Shieh | 242/365.6 |
| 5,740,974 | * | 4/1998 | Conzelman | 242/364.5 |
| 6,079,234 | * | 6/2000 | Hsiung | 66/132 R |

* cited by examiner

*Primary Examiner*—Emmanuel M. Marcelo
(74) *Attorney, Agent, or Firm*—Dougherty & Troxell

(57) ABSTRACT

A variable and steady yarn feeding apparatus is disclosed. The apparatus comprises a support; a drive device; a steady yarn supply drum for plain knitting; a variable yarn supply drum having a number of high friction resilient yarn guide surfaces, the variable yarn supply drum and steady yarn supply drum both driven by the drive device; a yarn guide device for guiding the yarn from the variable yarn supply drum to the steady yarn supply drum; a self-adjustable yarn guide device provided below the support; and a yarn brake for adjusting the yarn feed of the variable yarn supply drum. An end of a self-adjustable yarn guide device is away from the variable yarn supply drum when there is no yarn demand condition by an expansion of a spring provided therein, while the end of the self-adjustable yarn guide device is in contact with the surfaces of the variable yarn supply drum when there is a yarn demand. A jacquard knitting is made possible by the cooperation of the yarn brake with the variable yarn supply drum.

6 Claims, 7 Drawing Sheets

VARIABLE AND STEADY YARN FEEDING APPARATUS

BACKGROUND OF THE INVENTION

1. Field of the Invention

The present invention relates to a variable and steady yarn feeding device, and more particularly to a yarn feeding device of a circular knitting machine having a variable and a steady yarn feeding features.

2. Description of Related Art

Fabric, knitted by a circular knitting machine, has a variety of styles recently. It is required to add a variable yarn feed to a steady yarn feed in order to knit a variety of fabrics by configuring the yarn into a number of different tension yarns during the knitting process. As such, a yarn feeding apparatus having a variable yarn feed and a steady yarn feed features is desirable.

For example, a U.S. Pat. No. 4,890,464 entitled "POSITIVE FEEDING DEVICE FOR CIRCULAR KNITTING MACHINE" is provided to accomplish such goal. The apparatus comprises a yarn feeding mechanism, driven by a drive means, having a first yarn guide surface and a second yarn guide surface. A yarn lead-in side of the first yarn guide surface has a first yarn guide device provided, and a yarn lead-in side of the second yarn guide surface has a second yarn guide device provided respectively.

The U.S. Pat. No. 4,890,464 is characterized in that the friction between the yarn and the first yarn guide surface is larger than that between the yarn and the second yarn guide surface. As such, the yarn is fed through the second yarn guide surface for a plain knitting when the yarn feed is steady, while the yarn is fed through the first yarn guide surface for a jacquard knitting when the yarn feed is variable. As a result, a yarn feeding apparatus having a variable yarn feed and a steady yarn feed features is provided.

However, the prior art is unsatisfactory for the following reason. As to the first yarn guide surface, the yarn feed or not is determined by the friction between the yarn and the resilient surface as well as the tension of the yarn demand. As such, a maximum contact area between the yarn and the resilient surface is desirable for fulfilling the purpose of a large demand. In contrast, a minimum contact area (or even no contract) between the yarn and the resilient surface is desirable when there is no demand for avoiding yarn feed. It is noted the contacting angle or area between the yarn and the resilient surface is adjustable only by rotating the position of the first yarn guide device. It is claimed that the contacting angle or area between the yarn and the resilient surface is adjustable by changing the position of the first yarn guide device through a manual operation.

However, in fact, it is impossible for an operator to instantly and accurately adjust the position of the first yarn guide device during the knitting process if there is a sudden change of yarn demand. Accordingly, in practice, the first yarn guide device is pre-set to an intermediate position, i.e., an angle between the yarn and the resilient surface is between the maximum yarn feed (i.e., a maximum contacting angle between the yarn and the resilient surface) and no feeding (i.e., no contact or a minimum contacting angle). As such, a high rate of fabric fault is occurred if the first yarn guide device is not adjusted to an optimum position and/or the quality of the yarn is poor in detail, it is possible for the feeding quantity of yarn being not sufficient to the demand due to a small friction between the yarn and the resilient surface. Further, it is possible for a continuous yarn feed even if there is no demand due to a high friction between the yarn and the resilient surface. As a result, a poor fabric such as irregularity will be knitted.

An another prior art, a preferred embodiment of variable feeding device, is disclosed in U.S. Pat. No. 3,606,975 entitled "METHOD OF FEEDING YARN TO A KNITTING PLACE ON A TEXTLE MACHINE". The patent discloses the yarn feed speed is controlled by a detection circuit of the tension ring. Generally, the precision of an electronically controlled device is very high. However, the speed control of the motor is sometimes interfered by the environment when the yarn consumption is intermittent. Further, the knitting machine owner is mostly bothered by the unacceptable high fault rate of the tension ring which being in contact with the yarn frequently. Furthermore, it is required to replace the tension ring whenever there is a change in the yarn feed. As such, a frequent change of the tension ring and/or the tension ring adjustment is inevitable for knitting a variety of fabrics. This is a time-consuming process as well as a possible damage to the tension ring caused by such replacement. These drawbacks have not been solved in a kniting machine of the patent disclosed.

Thus, it is desirable to provide a variable and steady yarn feeding apparatus in order to overcome the above drawbacks of prior art.

SUMMARY OF THE INVENTION

It is an object of the present invention to provide a variable and steady yarn feeding apparatus for achieving the purposes of jacquard knitting and plain knitting as well as instantly and accurately adjusting the yarn feed speed based on demand.

It is another object of the present invention to provide a variable and steady yarn feeding apparatus wherein a high friction resilient yarn guide surface having a V shaped section is provided as a variable yarn supply drum. It is contemplated that the drawbacks of prior art such as yarn slipped on the resilient surface and yarn fault occurred on a high speed yarn feed are eliminated such that an improvement of yarn quality is made possible.

It is a further object of the present invention to provide a variable and steady yarn feeding apparatus wherein a self-adjustable yarn guide means is provided on the outgoing yarn path. The pivot angle is automatically adjusted by the yarn rate based on the tension requirement. By the guiding of the selfadjustable yarn guide means, the yarn will not be in contact with the resilient surface of the yarn supply drum when there is no demand, while the yarn will be completely in contact with the resilient surface of the yarn supply drum when there is a high demand. As a result, a feeding and a no feeding conditions are obtained in order to further improve the quality of the yarn.

It is a further object of the present invention to provide a variable and steady yarn feeding apparatus wherein a tension adjustable yarn brake is provided on the outgoing yarn path. It is contemplated that the frequent replacement of the tension ring occurred in the prior art is eliminated in accordance with the present invention.

To achieve the above and other objects, there is provided a variable and steady yarn feeding apparatus. The apparatus comprises a drive means; a variable yarn supply drum; a steady yarn supply drum, the variable yarn supply drum and steady yarn supply drum both driven by the drive means which further rotated by means of a number of belts in a multiple speed arrangement; a support; a yarn guide means secured onto the support having a plurality of eyes provided thereon for guiding the yarn from the variable yarn supply drum to the steady yarn supply drum; and a self-adjustable yarn guide means provided below the support and positioned adjacent to the variable yarn supply drum by a predetermined distance.

The variable and steady yarn feeding apparatus is further characterized in that the variable yarn supply drum is a light metal material made as a whole. The variable yarn supply drum comprises a number of cylindrical sections each having a V or U shaped surface provided on the circumference. A high friction resilient layer is provided on the surface of the V or U shaped surface and thus the yarn can be tightly wound thereon. A free end of the self-adjustable yarn guide means is away from the variable yarn supply drum When there is no demand condition by the expansion of the spring provided therein, i.e., by the guiding of the selfadjustable yarn guide means, the yarn will not be in contact with the resilient surface of the variable yarn supply drum when there is no demand, while the yarn will be completely in contact with the resilient surface of the variable yarn supply drum when there is a high demand because the yarn tension is strong enough to compress the spring to bring the free end of the self-adjustable yarn guide means closer to the variable yarn supply drum to cause a maximum contacting angle between the yarn and the variable yarn supply drum . As a result, a feeding and a no feeding conditions are obtained.

The variable and steady yarn feeding apparatus is further characterized in that the yarn tension is further adjustable by the outgoing yarn brake provided at the end portion of yarn feeding when a plurality of different yarns having different tensions are knitted and thus a jacquard knitting is made possible.

The variable and steady yarn feeding apparatus is further characterized in that it is simply required to wind the yarn a few times on the steady yarn supply drum in order to change from a variable yarn feed to a steady yarn feed and thus the tedious process of yarn rearrangement of prior art is eliminated.

The above and other objects, features and advantages of the present invention will become apparent from the following detailed description taken with the accompanying drawings.

DETAILED DESCRIPTION OF THE PREFERRED EMBODIMENTS

Figure 1:
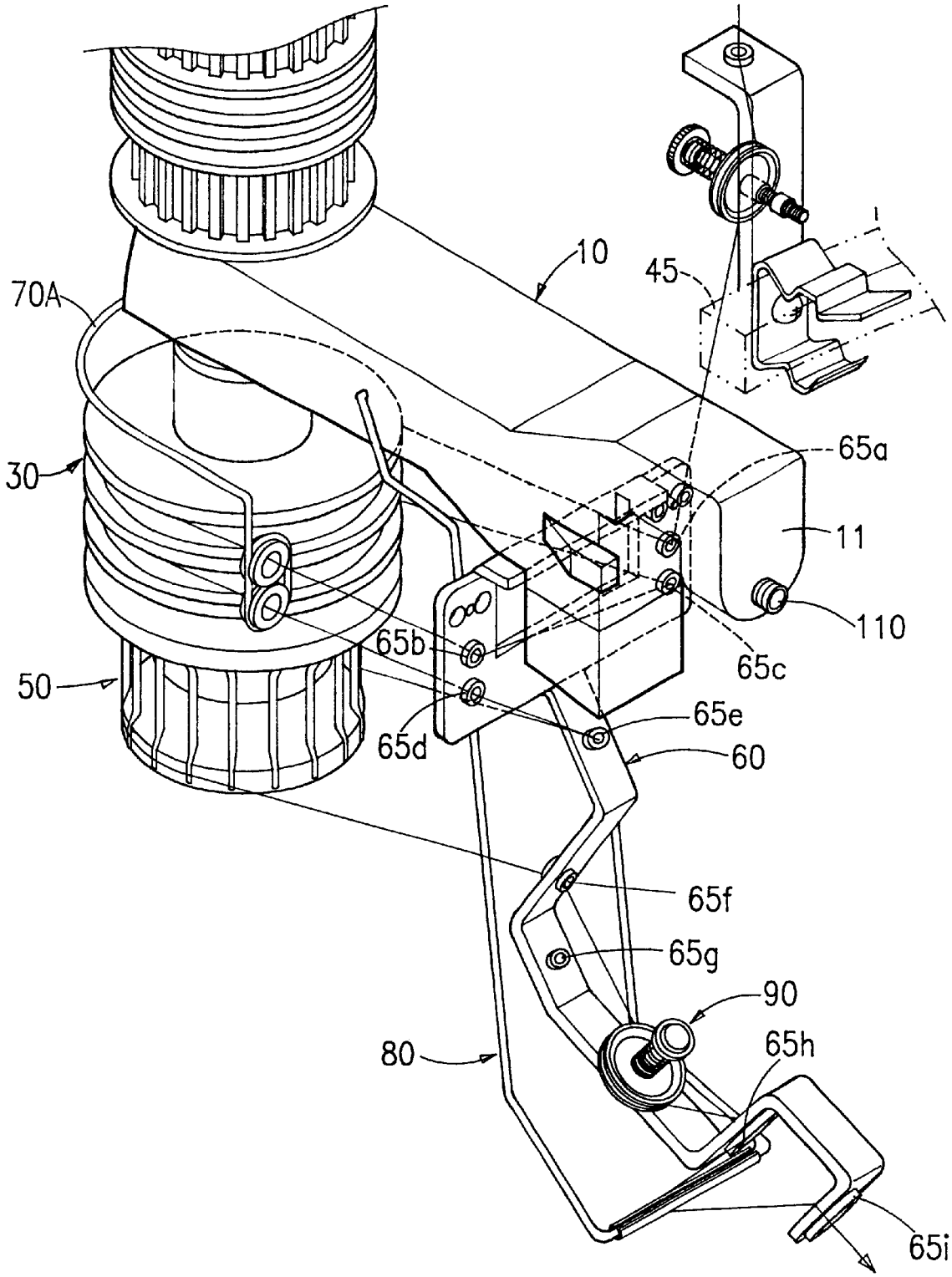
FIG. 1 is a perspective view of the variable and steady yarn feeding apparatus in accordance with the present invention.
Figure 2:
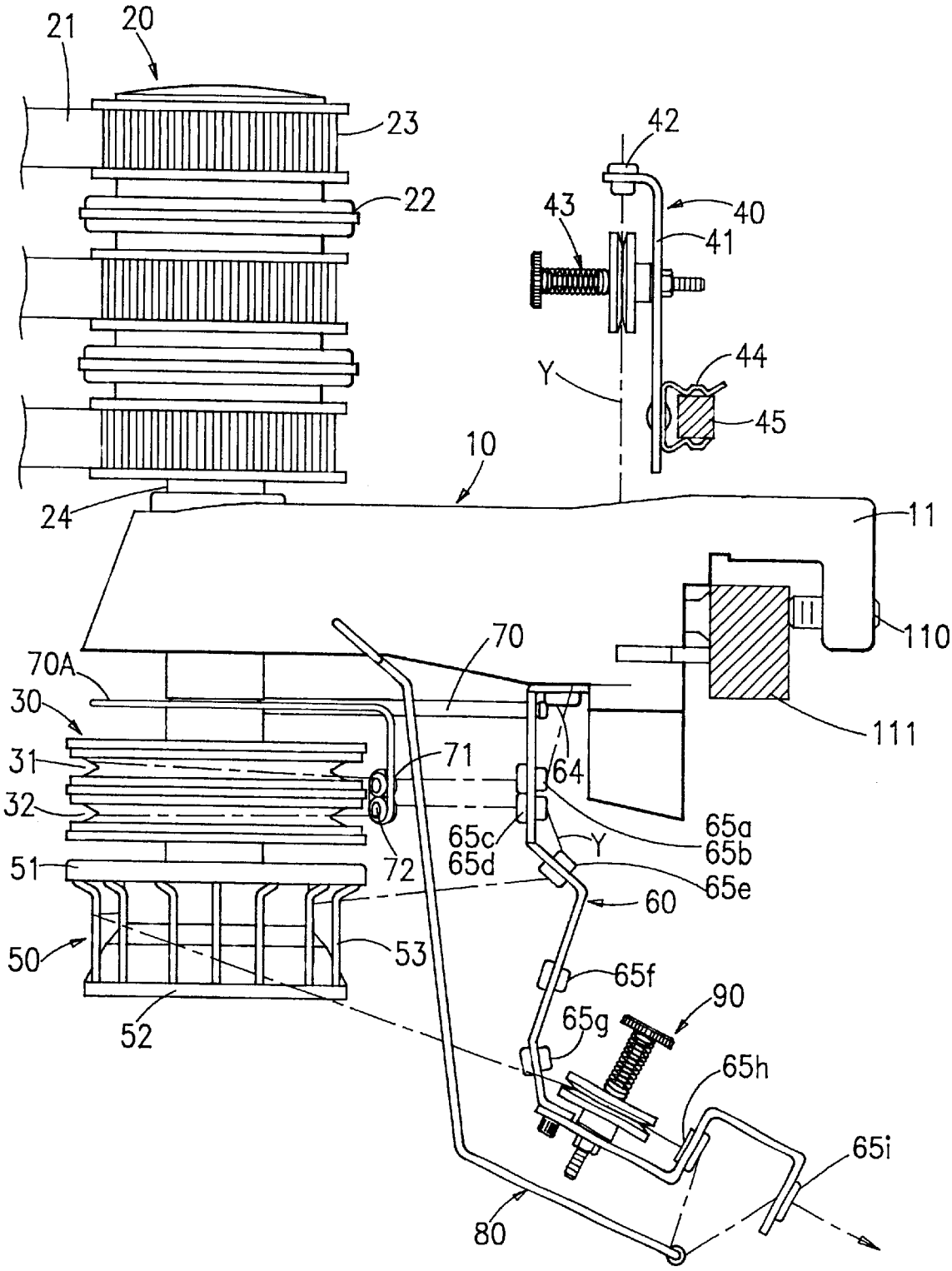
FIG. 2 is a front side view of FIG. 1 when the variable and steady yarn feeding apparatus is in a variable yarn feeding process.

Referring to FIGS. 1–2, there is shown a variable and steady yarn feeding apparatus in accordance with the present invention. The apparatus comprises a support 10, a drive means 20, a variable yarn supply drum 30, a first yarn guide means 40, a steady yarn supply drum 50, a yarn guide means 60, a selfadjustable yarn guide means 70 positioned around the variable yarn supply drum 30, a tension controller 80, and an adjustable yarn brake 90 wherein a fixer means 11 is provided on an end of the support 10 for being threadedly secured to a holding ring 111 by a screw 110; a first yarn guide means 40 provided on the top of the support 10 including a yarn guide arm 41 secured on a second holding ring 45 by a clamp 44, a yarn guide eye 42 provided on the top of the yarn guide arm 41, and a first yarn brake 43. The yarn Y is guided from the first yarn guide means 40 to eyes 65*a*–65*d* of the yarn guide means 60, the variable yarn supply drum 30, the self-adjustable yarn guide means 70, the steady yarn supply drum 50, the adjustable yarn brake 90, and to the tension controller 80.

The construction and operation of the yarn supply drums 30 and 50 and the drive means 20 are described below.

The drive means 20, provided on the top of the support 10, comprises a drive shaft 24, a number of belts 21, a corresponding number of pulleys 23 being driven by a drive source (not shown) over the belts 21, and a clutch 22 positioned between two adjacent pulleys 23 for providing a desirable rotation speed of the drive shaft 24 and the pulleys 23. The drive shaft 24 is extended downwardly through the support 10 to be attached to the variable yarn supply drum 30 and the steady yarn supply drum 50. Two V or U shaped surfaces 31 and 32 are provided on the variable yarn supply drum 30. The rotation speeds of the pulleys 23, the variable yarn supply drum 30, and the steady yarn supply drum 50 are identical because the pulleys 23, the variable yarn supply drum 30, and the steady yarn supply drum 50 are driven by the same drive shaft 24. The yarn guide means 60 functions as guiding the yarn Y from the variable yarn supply drum 30 to a knitting machine (not shown). The yarn guide means 60 is yarnedly secured onto the bottom of the support 10 by means of a bolt 64. A plurality of eyes 65*a*–651 are provided on the yarn guide means 60 each adapted to guide the yarn Y to a desirable direction such as guiding the yarn Y to or from the variable yarn supply drum 30 as well as guiding the yarn Y to or from the steady yarn supply drum 50.

Figure 3:
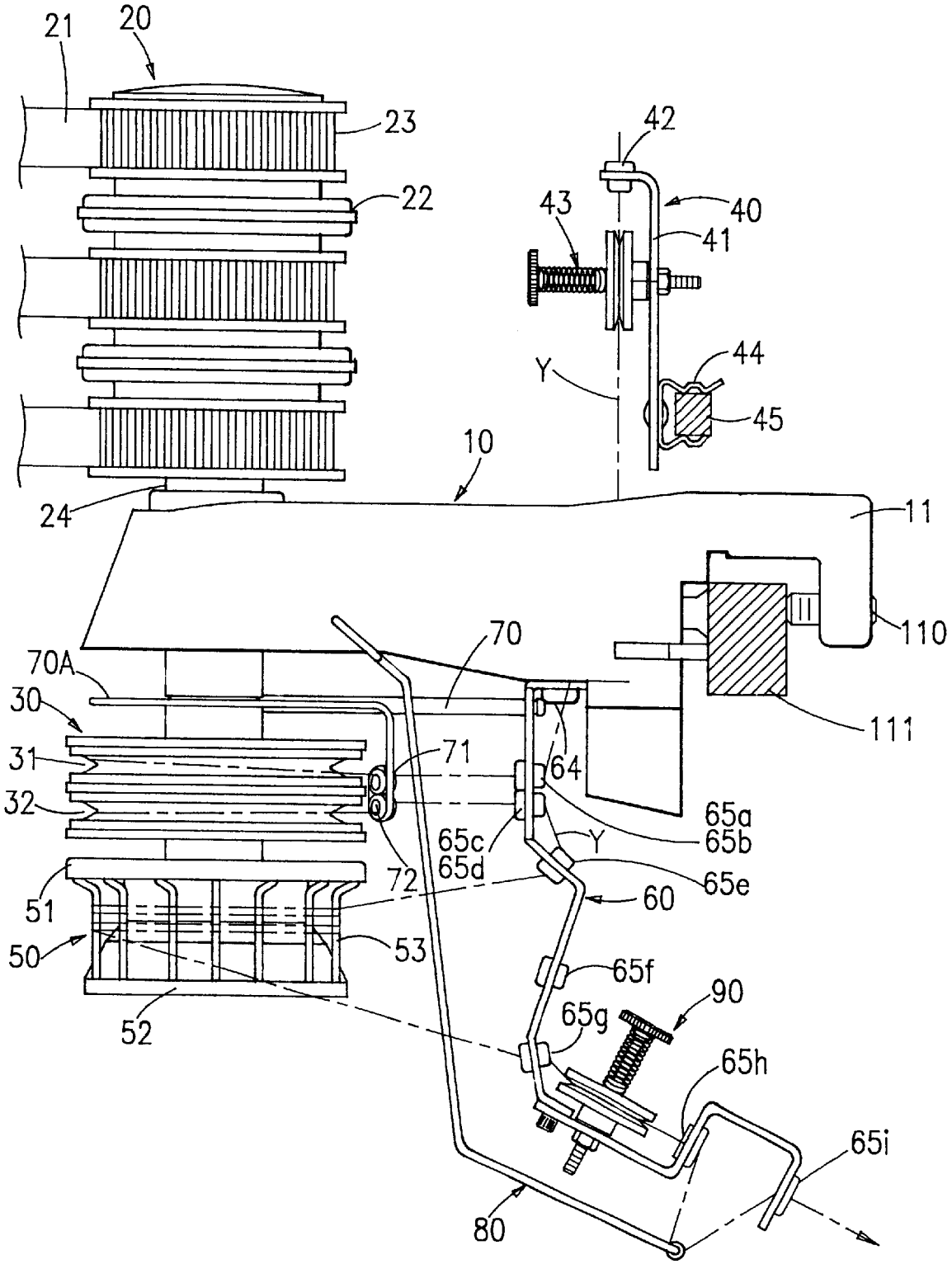
FIG. 3 is a front side view of FIG. 1 when the variable and steady yarn feeding apparatus is in a steady yarn feeding process.
Figure 4:
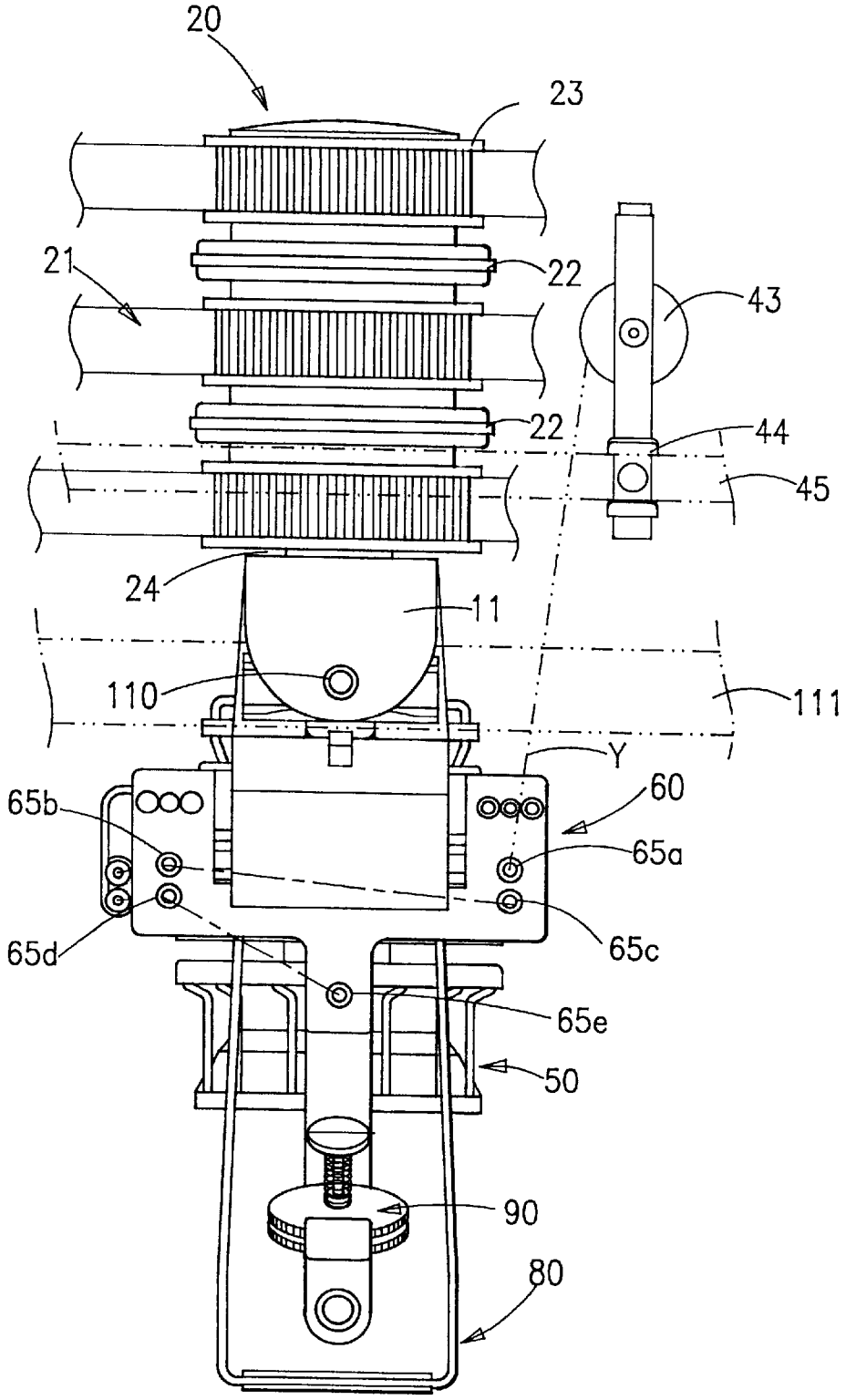
FIG. 4 is a right side view of FIG. 1 when the variable and steady yarn feeding apparatus is in a variable yarn feeding process.

As shown in FIGS. 2–4, a variable yarn feed process for jacquard knitting is illustrated. The yarn Y coming from the first yarn guide means 40 is guided through the eye 65*a*, the eye 65*b*, an upper yarn guide surface 31 of the variable yarn supply drum 30, an upper eye 71 of the self-adjustable yarn guide means 70, a lower yarn guide surface 32 of the variable yarn supply drum 30, a lower eye 72 of the self-adjustable yarn guide means 70, the eye 65*c*, the eye 65*d*, the eye 65*e*, and to the steady yarn supply drum 50 for being wound for a half winding thereon. Then the yarn Y coming from the steady yarn supply drum 50 is guided through the eye 65*f* or the eye 65*g*, the adjustable yarn brake 90, the eye 65*h*, the eye 65*i*, and finally to a knitting place (not shown).

Figure 5:
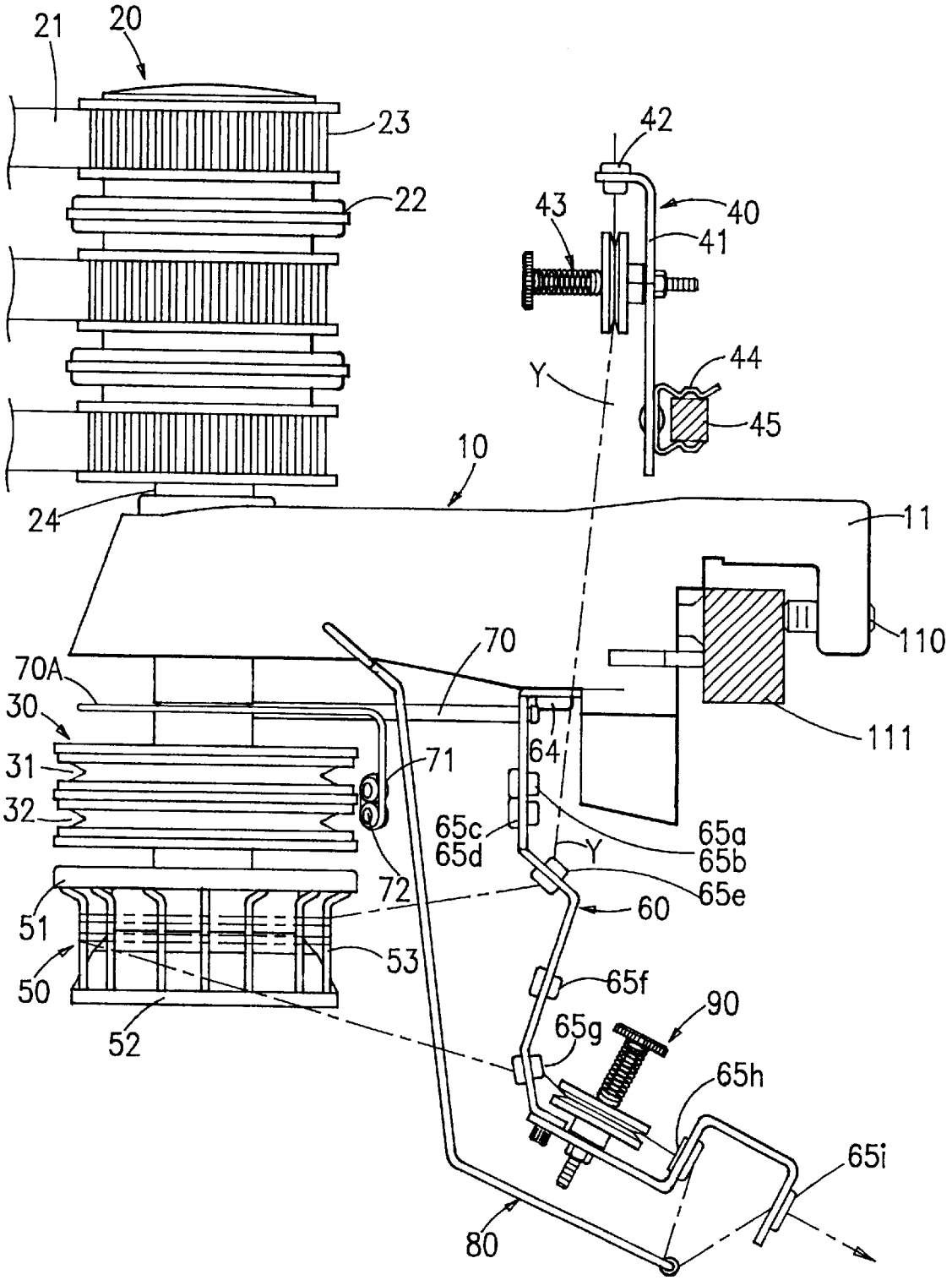
FIG. 5 is a front side view of FIG. 1 when the variable and steady yarn feeding apparatus is in a steady yarn feeding process.

As shown in FIG. 5, a steady yarn feed process for plain knitting is illustrated. The yarn Y coming from the first yarn brake 43 of the first yarn guide means 40 is guided through the eyes 65*a*–65*e*, the steady yarn supply drum 50, the eye 65*f*, the adjustable yarn brake 90, and to a knitting place (not shown). In the alterative, the yarn Y coming from the eye

65*f*is guided through the eye 65*h*, the eye 65*i*, and to a knitting place (not shown).

Figure 6:
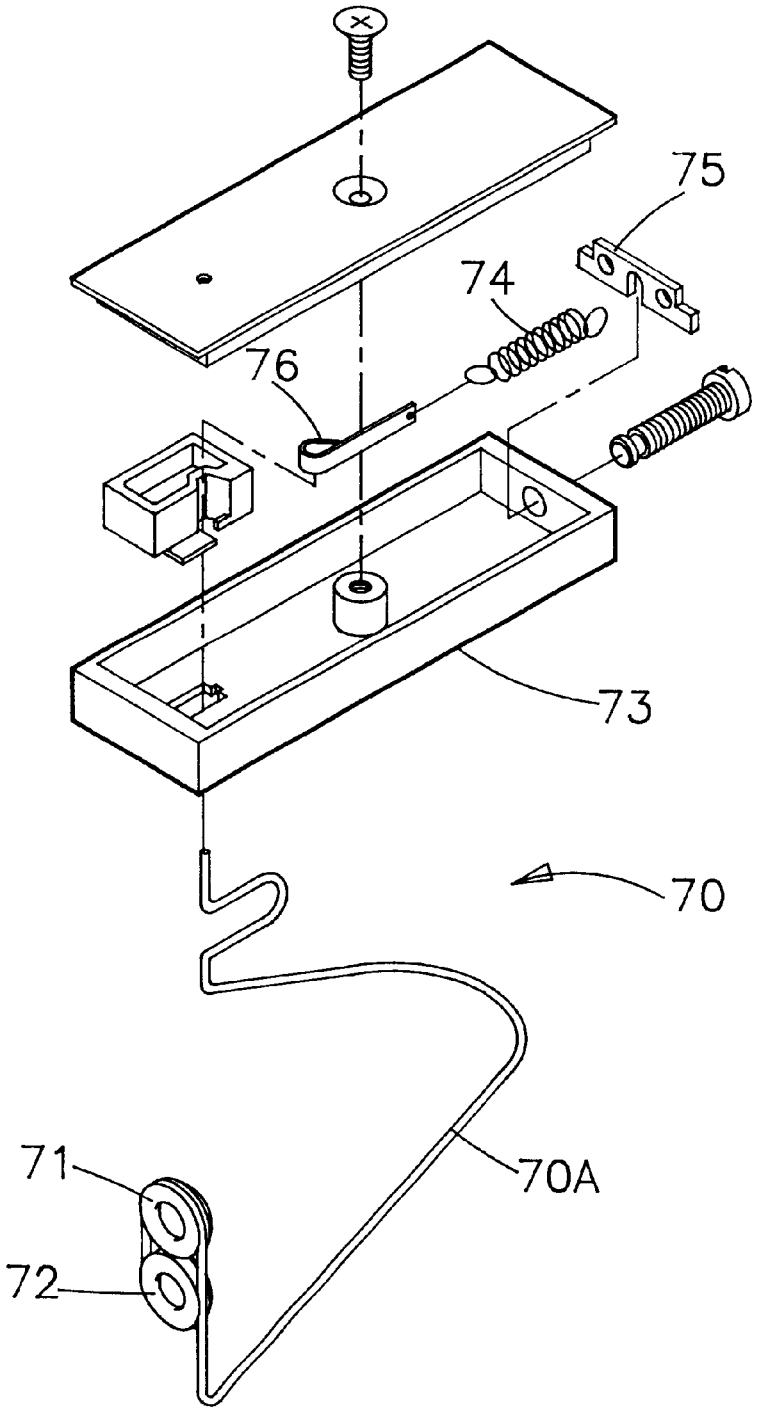
FIG. 6 is an exploded view of the self-adjustable yarn guide means of the variable and steady yarn feeding apparatus.
Figure 7:
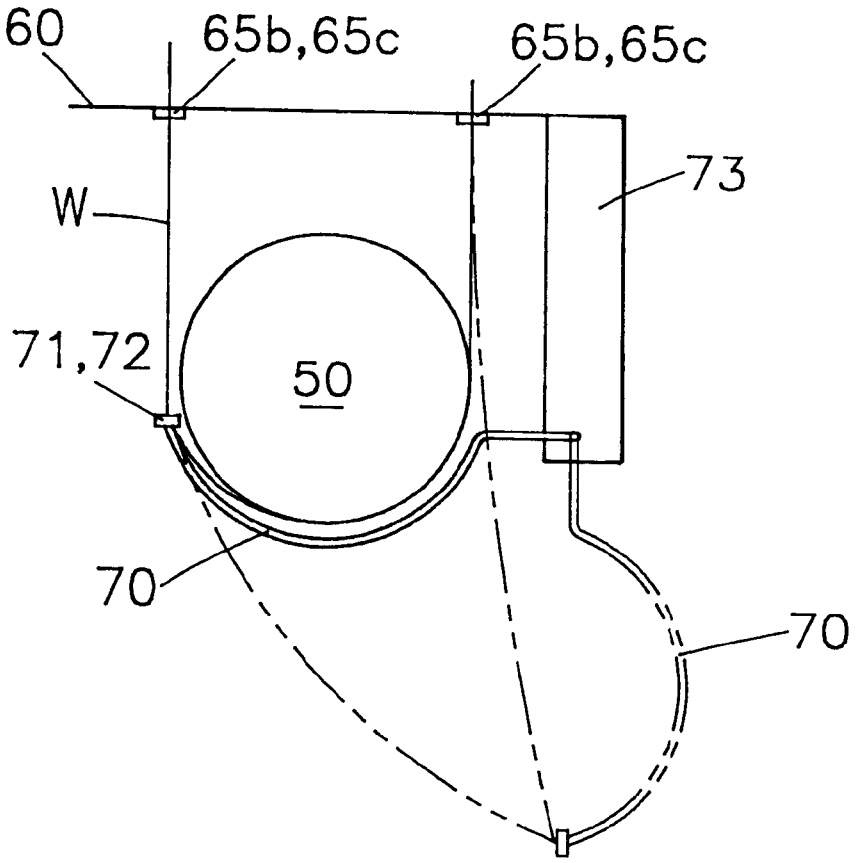
FIG. 7 is a schematic diagram illustrating the self-adjustable yarn guide means in cooperation with the variable yarn supply drum.

As shown in FIGS. 6–7, the components and operation of the self-adjustable yarn guide means 70 are illustrated. The self-adjustable yarn guide means 70 is designed to operate based on the yarn tension requirement. One end of the self-adjustable yarn guide means 70 is pivoted within a housing 73, while the other end of the self-adjustable yarn guide means 70 is a free end having the upper eye 71 and the lower eye 72 corresponding to the upper yarn guide surface 31 and the lower yarn guide surface 32 of the variable yarn supply drum 30 respectively. A spring 74 is provided within the housing 73. One end of the spring 74 is secured on the housing 73 or a detachable base member 75, while the other end of the spring 74 is secured on a hook shaped member 76. The free end of the self-adjustable yarn guide means 70 is away from the variable yarn supply drum 30 when there is in a little or no demand condition because the expansion of the spring 74 as indicated by the broken line in FIG. 7, i.e., the yarn Y will not be in contact with the surface of the variable yarn supply drum 30, while the yarn Y will be completely in contact with the surface of the variable yarn supply drum 30 when there is a high demand because the yarn tension is strong enough to compress the spring 74 to bring a yarn guide arm 70A of the self-adjustable yarn guide means 70 closer to the variable yarn supply drum 30 to cause a maximum contacting angle between the yarn Y and the surfaces 31 and 32 of the variable yarn supply drum 30 as indicated by line in FIG. 7.

While the invention herein disclosed has been described by means of specific embodiments, numerous modifications and variations could be made thereto by those skilled in the art without departing from the scope of the invention set forth in the claims.

What is claimed is:

1. A variable and steady yarn feeding apparatus comprising:

a support threadedly secured on a circular ring of a knitting machine;

a drive device provided the support driven by a plurality of belts;

an incoming yarn brake provided on a lead-in path for controlling a yarn tension thereof;

a variable yarn supply drum driven by the drive device and having a plurality of high friction resilient yarn guide surfaces;

a steady yarn supply drum provided below the variable yarn supply drum driven by the drive device and having a low friction yarn guide surface;

a yarn guide secured onto the support having a plurality of eyes provided thereon for guiding the yarn from the variable yarn supply drum to the steady yarn supply drum;

a self-adjustable yarn guide including a pivotally movable arm with a yarn guide eye provided at a free end thereof, said self-adjustable yarn guide provided below the support and positioned adjacent to the variable yarn supply drum by a predetermined distance, said free end of the movable arm of the self-adjustable yarn guide being away from the variable yarn supply drum when there is no yarn demand condition by expansion of a spring provided therein, while the free end of the movable arm is in contact with the surfaces of the variable yarn supply drum when there is a yarn demand; and an adjustable yarn brake provided on an end of an outgoing yarn path for further adjusting the yarn tension when a plurality of different yarns having different tensions are knitted.

2. The apparatus of claim 1, wherein the yarn guide surfaces of the variable yarn supply drum comprise an upper yarn guide surface and a lower yarn guide surface each having a U or V shaped cross-section.

3. The apparatus of claim 2, wherein an upper eye and a lower eye are provided on the self-adjustable yarn guide each corresponding to the upper yarn guide surface and the lower yarn guide surface of the variable yarn supply drum, respectively.

4. The apparatus of claim 1, wherein a top of the yarn guide is secured onto a bottom of the support.

5. The apparatus of claim 1, wherein the yarn guide surface of the variable yarn supply drum is a resilient surface made of a material selected from the group consisting of synthetic rubber and silicon rubber.

6. The apparatus of claim 1, wherein the more yarn demand is needed the more contact between the yarn and the surface of the variable yarn supply drum will be made.

* * * * *